US005689979A

United States Patent [19]

Yu

[11] Patent Number: 5,689,979

[45] Date of Patent: Nov. 25, 1997

[54] ZIPPER LOCK FOR LUGGAGE CASE CAPABLE OF LOCKING A BINDING STRAP

[76] Inventor: Chen-Te Yu, Suite 2, 7F. No. 95-8 Chang Ping Road, Sec. 1, Taichung, Taiwan

[21] Appl. No.: 643,381

[22] Filed: May 6, 1996

[51] Int. Cl.[6] ..... E05B 65/52; E05B 67/38

[52] U.S. Cl. ..... 70/69; 70/68; 70/312; 70/74

[58] Field of Search ..... 70/69, 67, 68, 70/18, 74, 312, 58

[56] References Cited

U.S. PATENT DOCUMENTS

| | | | |
|---|---|---|---|
| 622,776 | 4/1899 | Mellott | 70/69 |
| 3,319,743 | 5/1967 | Pelavin et al. | 70/68 |
| 3,597,945 | 8/1971 | Feinberg | 70/74 |
| 3,965,706 | 6/1976 | Davis | 70/68 |
| 4,066,195 | 1/1978 | Dickler | 224/8 R |
| 4,100,775 | 7/1978 | Bako | 70/3 |
| 4,366,684 | 1/1983 | Bako et al. | 70/68 |
| 4,771,617 | 9/1988 | Dueringer | 70/74 |
| 4,792,026 | 12/1988 | Dimmick et al. | 190/101 |
| 4,817,769 | 4/1989 | Saliba | 190/18 R |
| 4,856,306 | 8/1989 | Scelba et al. | 70/68 |
| 5,136,864 | 8/1992 | Spiekermann et al. | 70/68 |
| 5,557,954 | 9/1996 | Ling | 70/68 |

FOREIGN PATENT DOCUMENTS

| | | | |
|---|---|---|---|
| 2006334 | 12/1969 | France | 70/67 |

*Primary Examiner*—Steven N. Meyers
*Assistant Examiner*—Donald J. Lecher

[57] ABSTRACT

A zipper lock for luggage case comprises a housing including a pair of concaves capable of receiving a pair of pull tabs of a double zipper so as to lock up the tabs therein by a pair of the first latching means and a pair of second latching means worked in cencert with the first latching means provided to lock up a binding strap which has a coupler and a locking plate at two ends made in conforming with the shape of the housing. The housing contains also a combination lock. When the combination lock is set on-combination, to unlock the pull tabs and the binding strap only press a mannual push button inwardly to the housing. The binding strap can bind additional luggage cases or handbags and lock them together with parent luggage case.

6 Claims, 11 Drawing Sheets

ZIPPER LOCK FOR LUGGAGE CASE CAPABLE OF LOCKING A BINDING STRAP

BACKGROUND OF THE INVENTION

The present invention relates to luggage locks and more particularly to a zipper lock for luggage case which lock locks the slider pull tabs of a double zipper and simultaneously locks a binding strap which is provided to lock up additional luggage cases and/or handbags together with the parent luggage case.

Currently, a portable luggage case, as shown in FIG. 1 is popular in travelling, which has a retractable frame slidably fixed on the back side and the casters at the bottom for facilitating the trolley of the luggage case. On the soft-sides of the luggage case has a double zipper, the sliders of which are locked together to prevent access to the interior of the case. The simplest way to lock together the double zipper may be constituted by a padlock, but the key may be lost. The more sophisticated double zipper locks are disclosed in U.S. Pat. Nos. 4,031,723; 4,336,684; 3,319,734; 3,597,945 and 3,978,697. All of these double zipper locks need a post inserting through an opening of each zipper pull tab. Other structure, such as a cover plate, is provided to prevent removal of the pull tabs from the post, so as to retain the sliders therein. U.S. Pat. No. 4,856,306 disclosed a zipper locking apparatus has chamber-defining wall means for enclosing and trapping the zipper slider within the chamber when the chamber is closed. However, none of these prior art references provide a multi-functional zipper lock for luggage case as provide in the present invention.

SUMMARY OF THE PRESENT INVENTION

The present invention has a main object to provide a multi-functional zipper lock for luggage case which has an elastic locking device to directly lock the pull tabs of the slider of a double zipper in the luggage case.

Another object of the present invention is to provide a zipper lock for a luggage case which has slotted locking device for simultaneously locking up a binding strap together with the parent luggage case.

Still another object of the present invention is to provide a zipper lock for luggage case which the binding strap is applied to lock up a series of additional luggages or other handbags together with the parent luggage case on a column or a door handle.

Further object of the present invention is to provide a zipper lock for luggage case which lock can be attached to a briefcase or portfolios for simultaneously locking up a double zipper pocket and another locking tab therein.

Still further object of the present invention is to provide a zipper lock for luggage case which the binding strap can be adapted to pack the luggage case itself for protecting the retractable frame and the double zipper from a disconnection.

To fullfill its broader aspects, the zipper lock according to the present invention comprised a lock to be attached to a luggage case for forming a pair of concaves capable of locking and unlocking the pull tabs of the sliders of a double zipper in the case and a pair of latching slots capable of simultaneously locking and unlocking a pair of locking tabs from an additional binding strap or from a lid of a briefcase.

The present invention will become more fully understood by reference to the following detailed description thereof when read in conjunction with the attached drawings.

DETAILED DESCRIPTION OF THE PREFERRED EMBODIMENT

Figure 6:
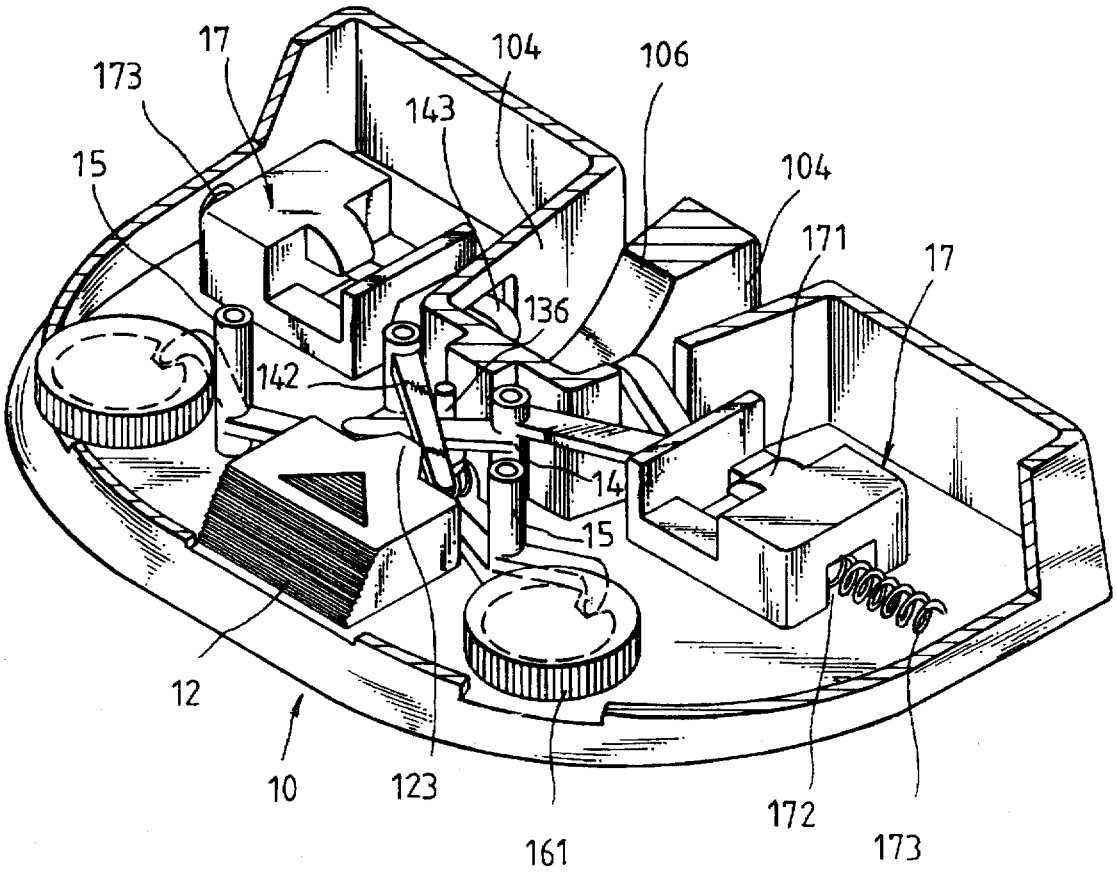
FIGS. 6 and 7 are a perspective view and a top sectional view to show a assembled zipper lock of the present invention.
Figure 7:
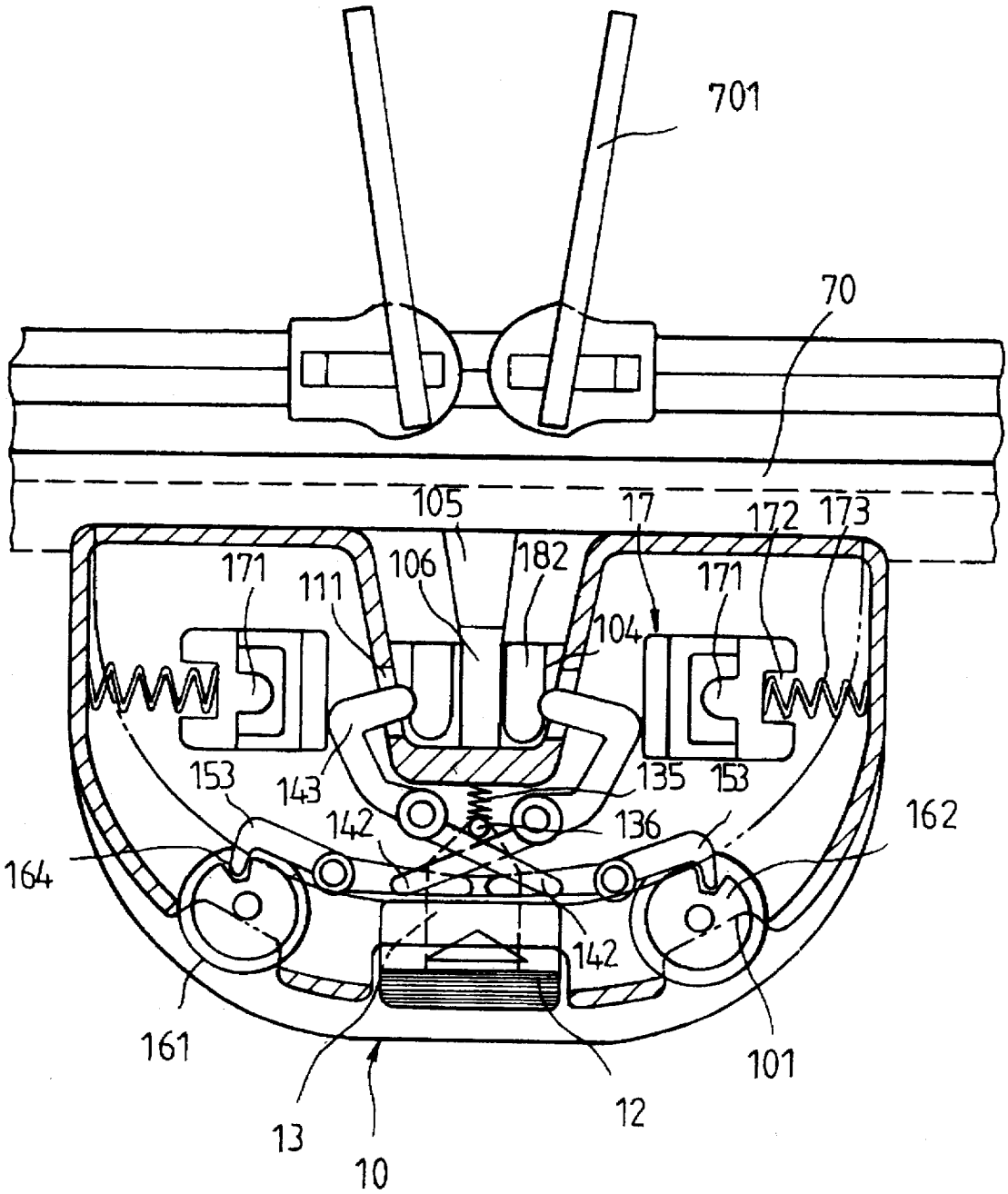

Referring to FIGS. 2, 3, 4 and 5 of the drawings, the zipper lock of the present invention comprises a cam surfaced housing 10 having generally a cam rectangular opening 102 at the middle of an arcuate slopped portion for receiving a push button 12 therein, a pair of small windows 101 symmetrically formed at the corners of the slopped portion adjacent the opening 102 for receiving a pair of dials 16 of a combination lock therein, a pair of concaves 104 partitioned by a projection 105 at a middle of a flat portion opposite to the arcuate slopped portion of the housing 10 for respectively receiving a pair of pull tabs 701 of a double zipper 70 in a luggage case 40, the projection 105 has a concave 106 at inner portion and a pair of first latching slots 103 symmetrically formed through the pain upper wall of the housing 10 for locking up the locking pins 331 of a binding strap 30 or a lip of a briefcase 50. Inside the housing 10, there are two pairs of cylinder post **106*a* and 106*b*, and a pair pivots 106*c* spacedly projected downward from the internal surface of the upper wall thereof, a pair of tubular members 107 having threaded inner periphery for securing the lock onto the luggage case 40 by means of a retaining plate (not shown), an enclosed roughly U-shaped bulk head 11 connected with the inner wall of the flat portion thereof and surrounding the projection 105 and the concaves 104 which has one end perpendicular to the transverse wall of the U-shaped and the other end connected to a transverse abutment 116, a pair of second latching slots 111 formed on the lateral walls of the U-shaped bulk head 11, a pair of protrudent retainers 117 projected spaced apart from the bottom of the abutment 116, a first spring seat 108*a* formed at the middle of the transverse wall of the U-shaped bulk head 11, a pair of second spring seats 108***b* symmetrically formed abutting the inner surface of the opposite lateral walls of the housing 10, a plurality of internally threaded tubular members 109 projected downward from four corners of the housing 10 for engaging the housing 10 with a lid 19, two pair of positioning plates 110 spacedly projected downward from the inner surface of the housing 10 adjacent the respective second spring seats 108*b*, a pair of roughly triangular side walls 115 abutting the opening 102 and bridged by a second transverse abutment 112 which has a pair of protrudent numbers 113 projected downward from the bottom thereof and a recess 114 at the middle of it's inward side. The housing 10 further comprises a push button 12 as recited above slidingly disposed into the opening 102, the push button 12 has a stem made in registry with the recess 114 centrally projected downward from the bottom, a pair of retaining pieces 122 at the fore end abutting respective lateral sides which are prepared to stop against the inward edge of the triangular side walls 115, a wedged portion 123 projected transversely from the middle of the fore end between the retaining pieces 122 and a rectangular recess 124 centrally formed at fore end beneath the wedged portion 123, an actuator member 13 slidingly disposed into the housing 10 beneath the push button 12 having a flat rectangular portion 131 received by the recess 124 therein, a hollow wedged portion 132 for enclosing the wedged portion 123 of the push button 12, an aperture 133 centrally formed through the bottom, a third spring seat 134 which is made in registry with the first spring seat 108*a* centrally formed at fore end, a first spring 135 biased between the seats 134 and 108*a* and a support stem 136 which is prepared to maintain a horizontal balancement between the push button 12 and the actuator member 13, centrally projected upward from the seat 134 and stopped against the inner surface of the housing 10, a pair of first latching means 14 each having a sleeve 141 pivoted on the posts 106*a* inside the housing 10 in symmetrical manner, a latch 143 towards the latching slot 111 extended outward from the sleeve 141 and a lever 142 extended outward from the opposite side of the sleeve 141 and intersecting each other with their intersection stopped against the support stem 136 and the wedged portion 123 therebetween (as shown in FIGS. 6 and 7), a pair of coupling means 15 each having a sleeve 151 pivoted onto the posts 106*b* inside the housing 10 in symmetrical manner, an extension extended laterally from a periphery of the sleeve 151 having a perpendicular portion 152 at free end engaged with the aperture 133 therein and another extension extended laterally from an opposite periphery of the sleeve 151 having a hook 153 at free end engageable with a dial of a combination lock 16, the combination lock 16 being in well known type comprised of a pair of dials pivoted onto the pair of pivots 106*c* respectively each having a warded member 161 accessible from the windows 101, an annular base 162 rotated in concert with the warded member 161 and biased by a second spring 163, the base 162 having a recess 164 on a periphery which is engageable with the hook 153 when the lock is in unlatching position, a pair of second latching means 17 slidingly disposed into the housing 10 between the latch 143 of the first latching means 14 and the pair of second spring seat 108*b* and limited by the positioning plates 110 and a pair of third springs 173 which bias between the outward ends of the second latching means 17 and the pair of the second spring seats 180*b* inside the housing 10, the second latching means 17 each having a hollow rectangular body, a beveled latch 171 made in registry with the latching slot 103 and a fourth spring seat 172 at outward end thereof for biasing one end of the third spring 173, a U-shaped spring plate 18 having a pair of screw holes 181 spacedly formed in a transverse portion for securing the plate 18 onto the protrudent retainers 117 and a pair of arcuate lateral portions 182 extended into the concaves 104 for receiving the pull tabs of a double zipper thereon when the lock is in latching position and ejecting the pull tabs up when the lock is in unlatching position, finally, a lid 19 which has a flat body conforming with the bottom of the housing 10 and a plurality of screw holes 191 formed spaced apart in the body made in registry with the threaded tubular members 109 in the housing 10, secured onto the bottom of the housing 10 by fastening means. The lid 19 further has a pair of screw holes 192 adjacent a flat portion thereof made in registry with the protrudent retainers 117 of the housing 10 for screw securing the spring plate 18 therebetween.

The zipper lock is attached to the soft-side of a luggage case 40 adjacent the closed position of the double zipper as shown in FIG. 7.

Figure 5:
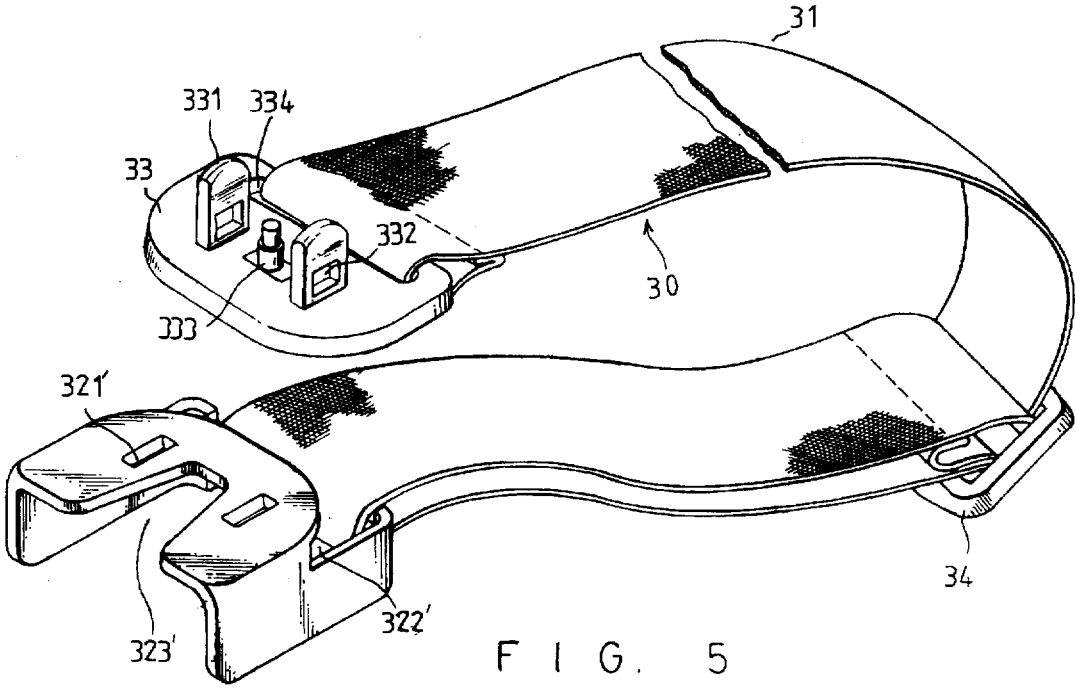
FIGS. 4 and 5 are the perspective views to show a binding strap bound with a coupler and a locking plate at two ends of the strap according to the present invention.
Figure 4:
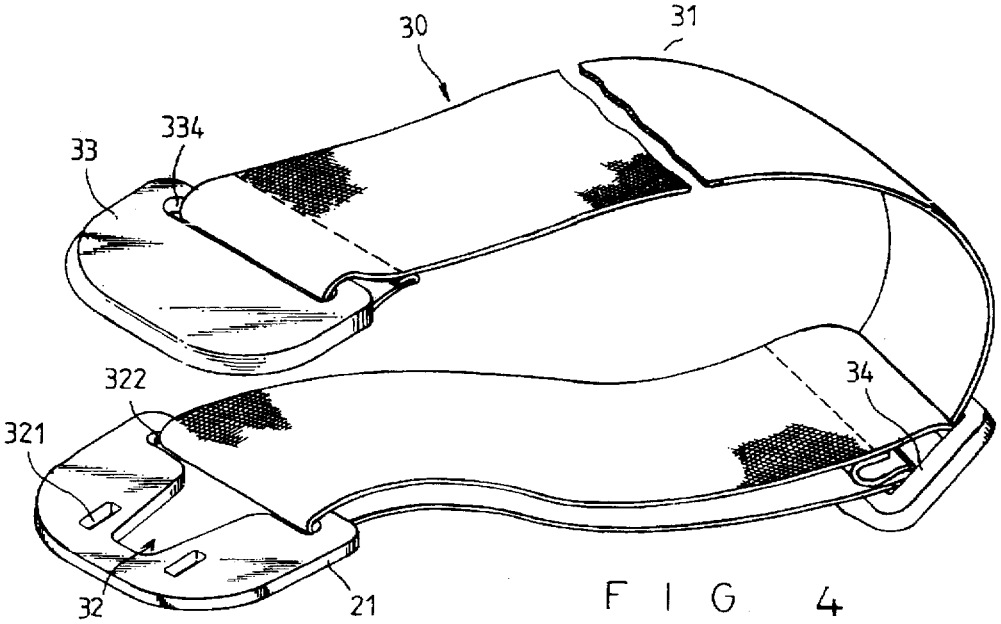

The binding strap 30 as shown in FIGS. 4 and 5 comprises a strap 31, a coupler 32, a locking plate 33 and a buckle 34. Both of the coupler 32 and the locking plate 33 have a flat body conforming with the shape of the outer appearance of the cam surfaced housing 10 of the zipper lock. The coupler 32 has a pair of third latching slots 321 made in registry with the first latching slots 103 of the housing 10 of the lock 10 and a first opening 322 for crossing fastening the strap 31, where the locking plate 33 has a pair of locking pins 331 each having an eyelet 332 (as shown in FIG. 5) which is lockable by the second latching means 17 under the latching slots 103, a spring rod 333 at the middle of the locking pins 331 therebetween and a second opening 334 for fastening one end of the strap 31. The other end of the strap 31 is fastened with the buckle after crossing the first opening 322 of the coupler 32. The spring rod 333 stops against the concave 106 when the locking plate 33 is locked in and ejects the locking plate 33 and the coupler 32 therefrom when is unlocking.

FIG. 5 shows another embodiment of a coupler 32' which has a raised flat body, a pair of latching slots 321', a frame 322' for crossing fastening the strap 31 and a bight portion 323'. The strap 31 is made from soft but tough material and received in a pocket at the front of the luggage case 40 when not in use.

Figure 1:
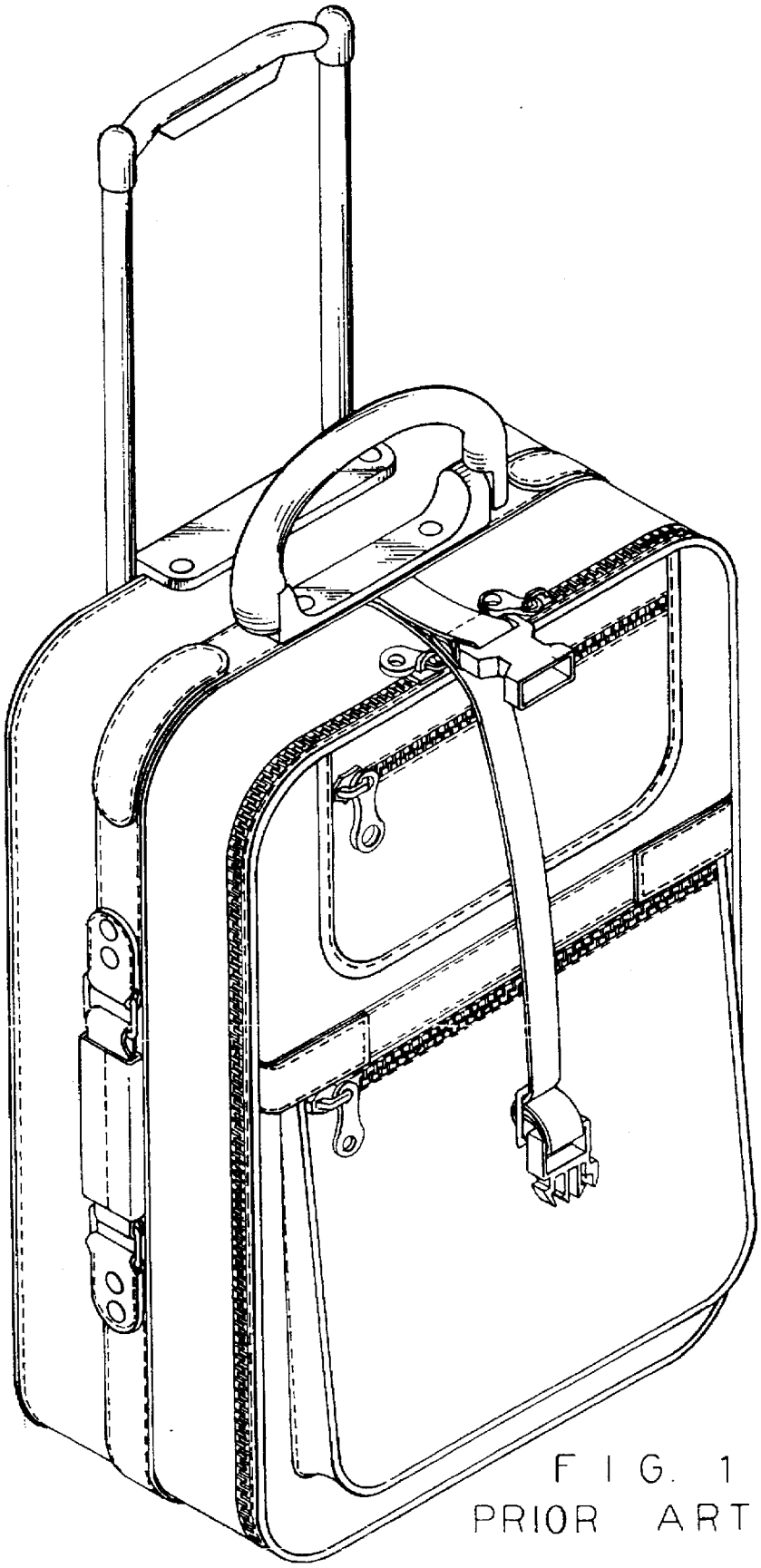
FIG. 1 PRIOR ART
FIG. 1 is a perspective view to show a portable luggage case of a prior art.
Figure 2:
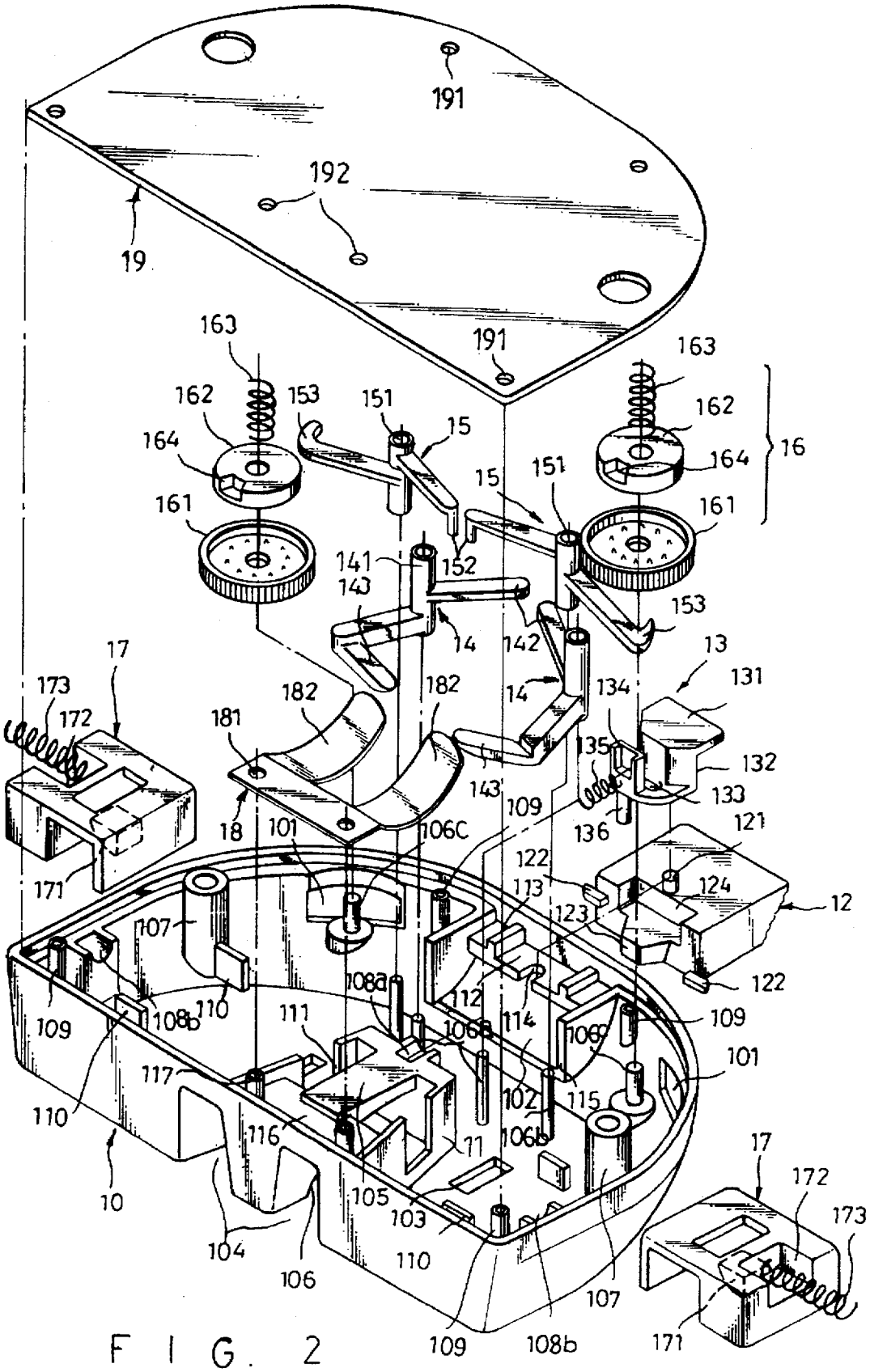
FIG. 2 is an exploded perspective view to show a zipper lock of the preferred embodiment according to the present invention.
Figure 3:
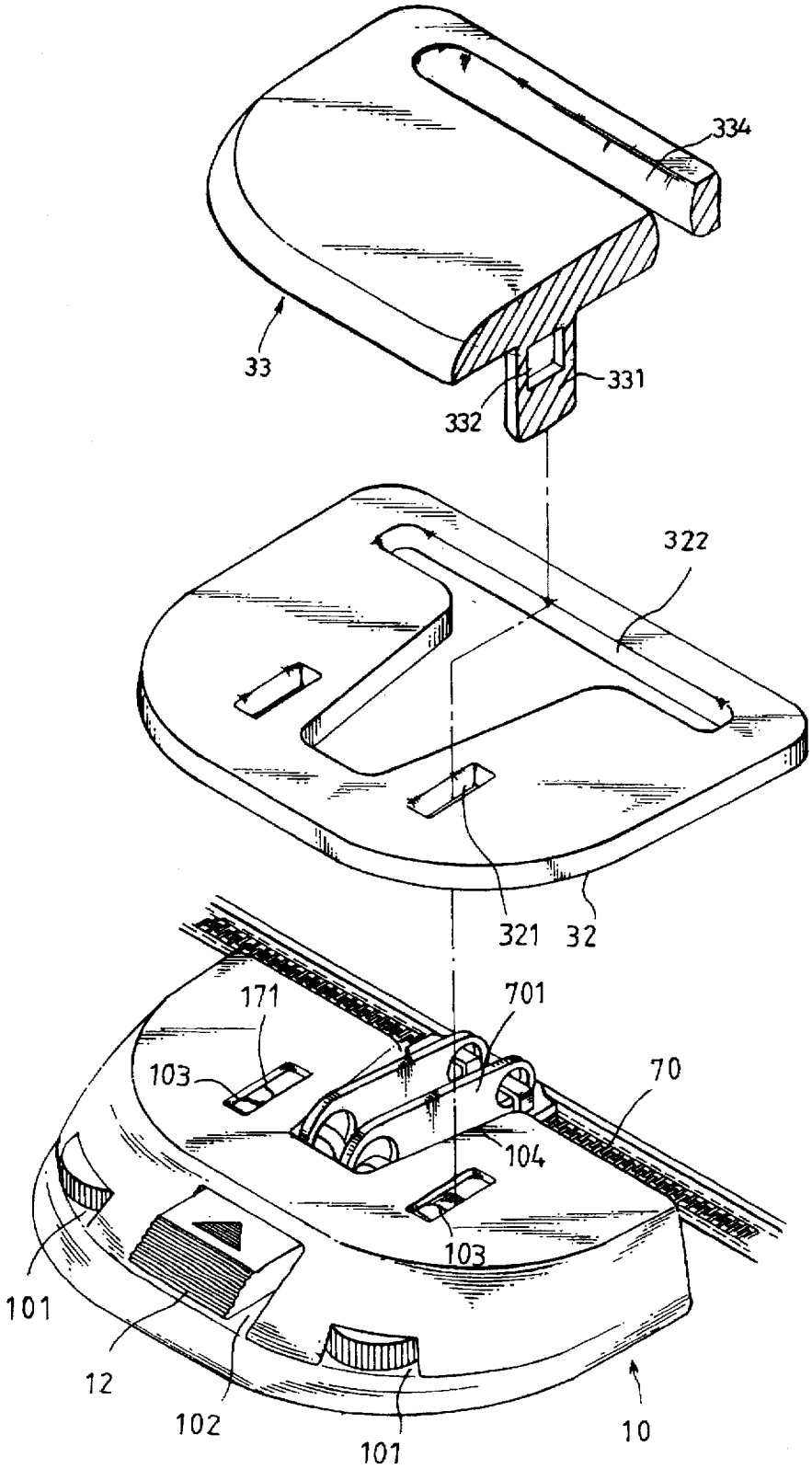
FIG. 3 is an exploded perspective view to show the zipper lock of the present invention is attached to a luggage case as the pull tabs of the double zipper are locked up and a locking plate together with a coupler which are about to be locked up into the latching slots.
Figure 8:
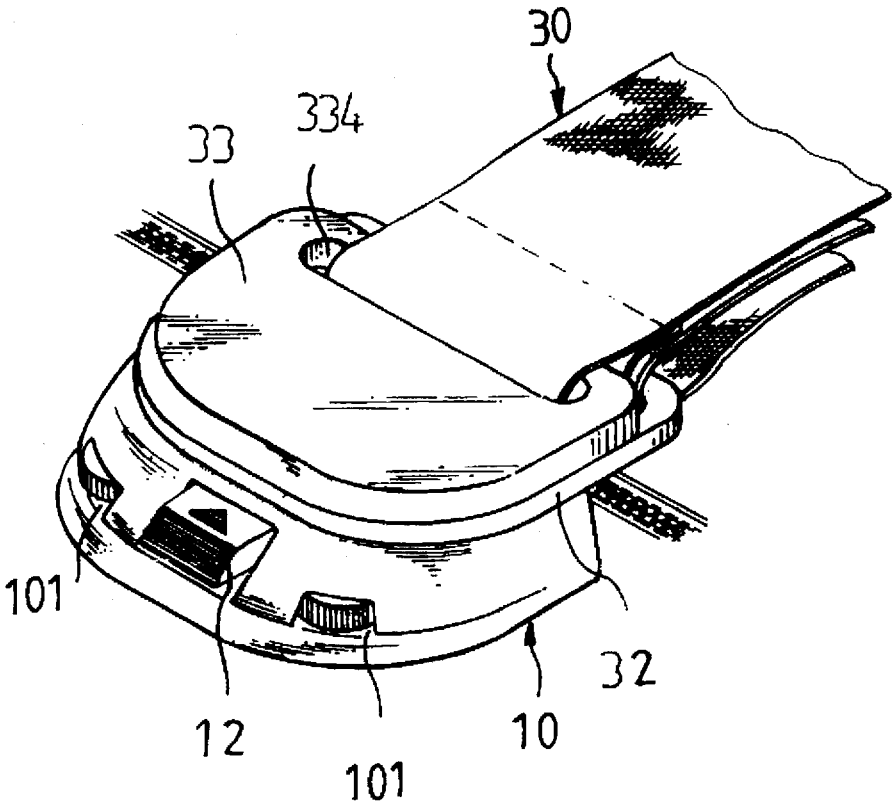
FIG. 8 is a perspective view to show the binding strap being properly locked up in the zipper lock according to the present invention.

Referring to FIGS. 3, 6 and 7 of the drawings which describe the operation of the zipper lock of the present invention. When the combination lock 16 is set on-combination (as shown in FIG. 7), the push button 12 is free to be pushed to make inwardly translational movement against the intersection of the levers 142 of the first latching means 14 via the actuator member 13 so as to leverly force the latches 143 moving inward from the latching slots 111 to permit the pull tabs of the double zipper to be pressed into the respective concaves 104, then turns the dials 161 to let the hooks 153 of the coupling means 15 disengageable with the recesses 164 of the dials 161. So that the first spring 135 urges the actuator member 13 moving outward against the inward side of the intersection of the levers 142 of the first latching means 14 so as to leverly force the latches 143 moving outward from the latching slots 111 to stop against the eyelet of the pull tabs of the double zipper therein, thereby the tabs are locked up. When the combination lock 16 is set on-combination again, the zipper lock is unlocking as recited above. Note that the second latching means 17 moves laterally in concert with the first latching means 14. When the latches 143 of the first latching means 14 move inward from the latching slots 111, it simultaneously push the second latching means 17 moving towards the lateral walls of the housing 10. When the latches 143 of the first latching means 14 move outward from the latching slots 111, the second latching means 17 urged by the third springs 173 move towards the latching slots 111 in concert with the latches 143. So that the beveled latches 171 of the second latching means 17 aligned with the latching slots 103 when the zipper lock is in locking up state. However, the beveled latches 171 are pressed to move laterally when the locking pins 331 of the locking plate 33 insert into the latching slots 103 and move back to automatically lock up the locking pins 331 under the resilient force of the third springs 173. When the combination lock 16 is set on-combination, translates the push button 12 so that both of the pull tabs 701 of the double zipper 70 and the locking pins 331 are simultaneously unlocked up. To lock the locking strap into the zipper lock, it must couple the locking plate 33 together with the coupler 32 to have the locking pins 331 inserted into the latching slots 321 at first and then mounts them onto the zipper lock that to be locked up therein (as shown in FIG. 8).

Figure 9:
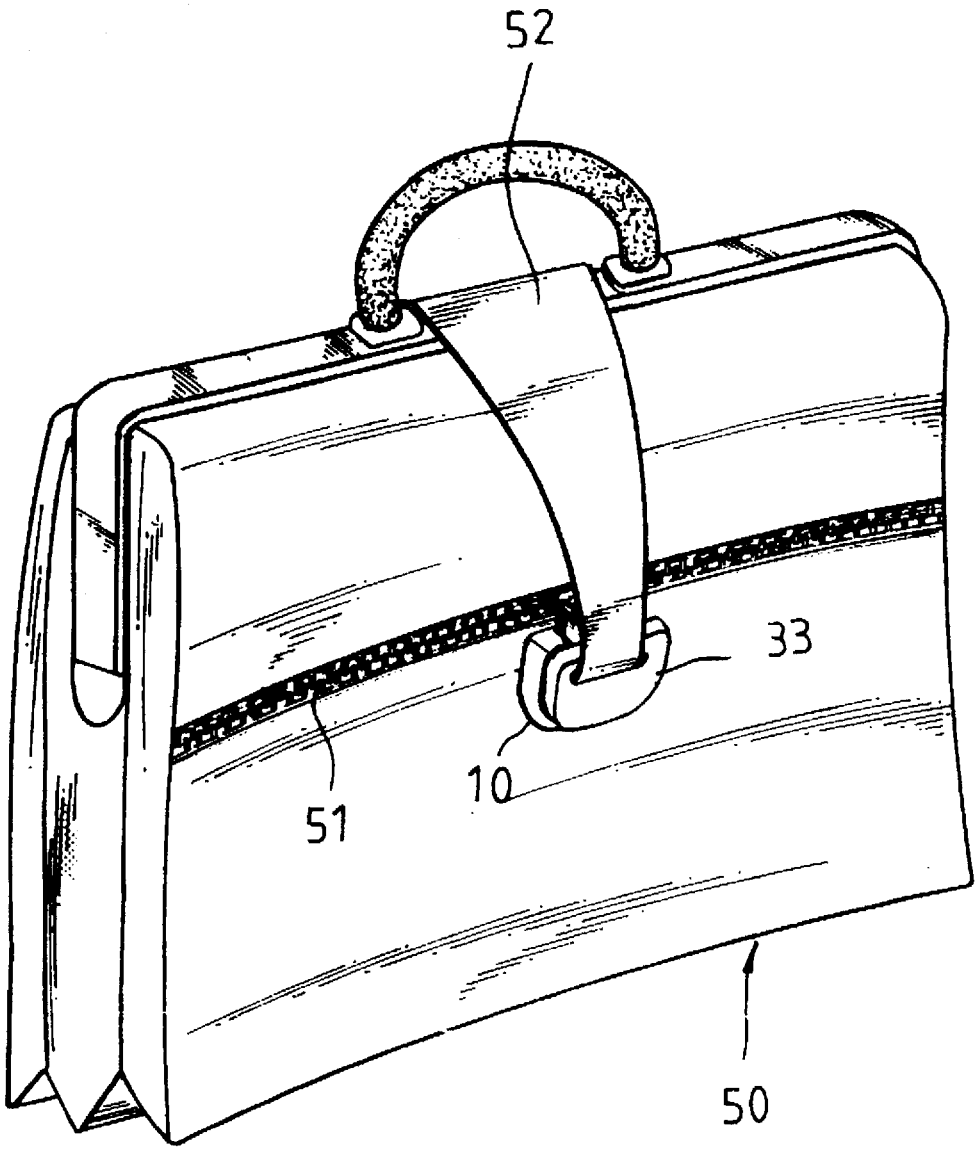
FIG. 9 is a perspective view to show another instance that the zipper lock and a locking plate of the present invention are adapted to a briefcase.

Referring to FIG. 9, which shows another instance as to adapt the zipper lock of the present invention to a briefcase 50, the case 50 has a double zipper 51 at a front portion and tab 52. The zipper lock 10 attaches to the front portion of the case 50 adjacent the pull tabs of the double zipper 51 and the locking plate 33 attaches to the free end of the tab 52. When the pull tabs is locked up, the locking plate 33 also locks up its locking tabs into the zipper lock 10 so as to provide greater effect to prevent burglary.

Figure 10:
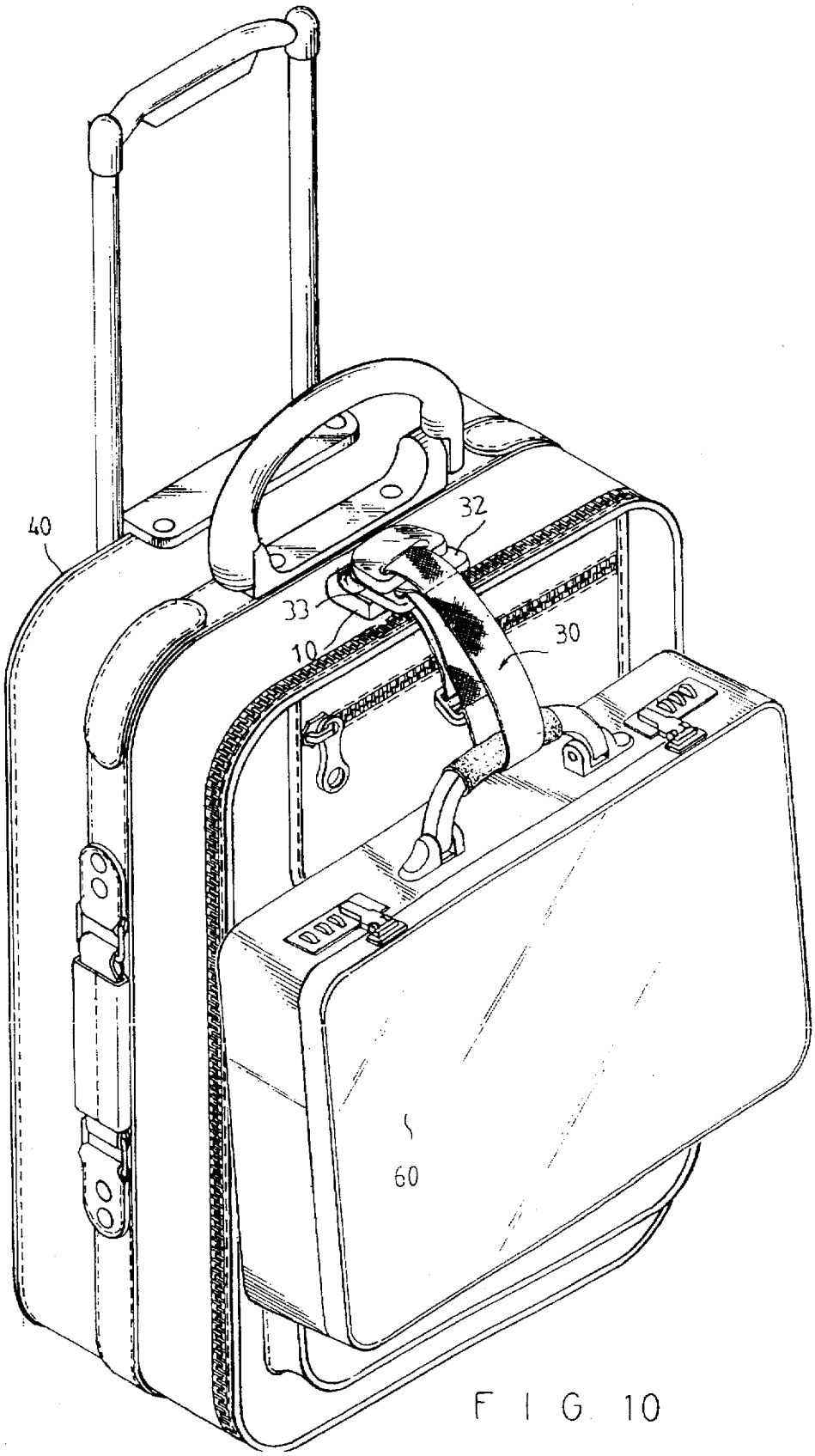
FIG. 10 is a perspective view to show a first operational mode which illustrates a binding strap of the present invention applied to associate an additional suitcase with the parent luggage case.
Figure 11:
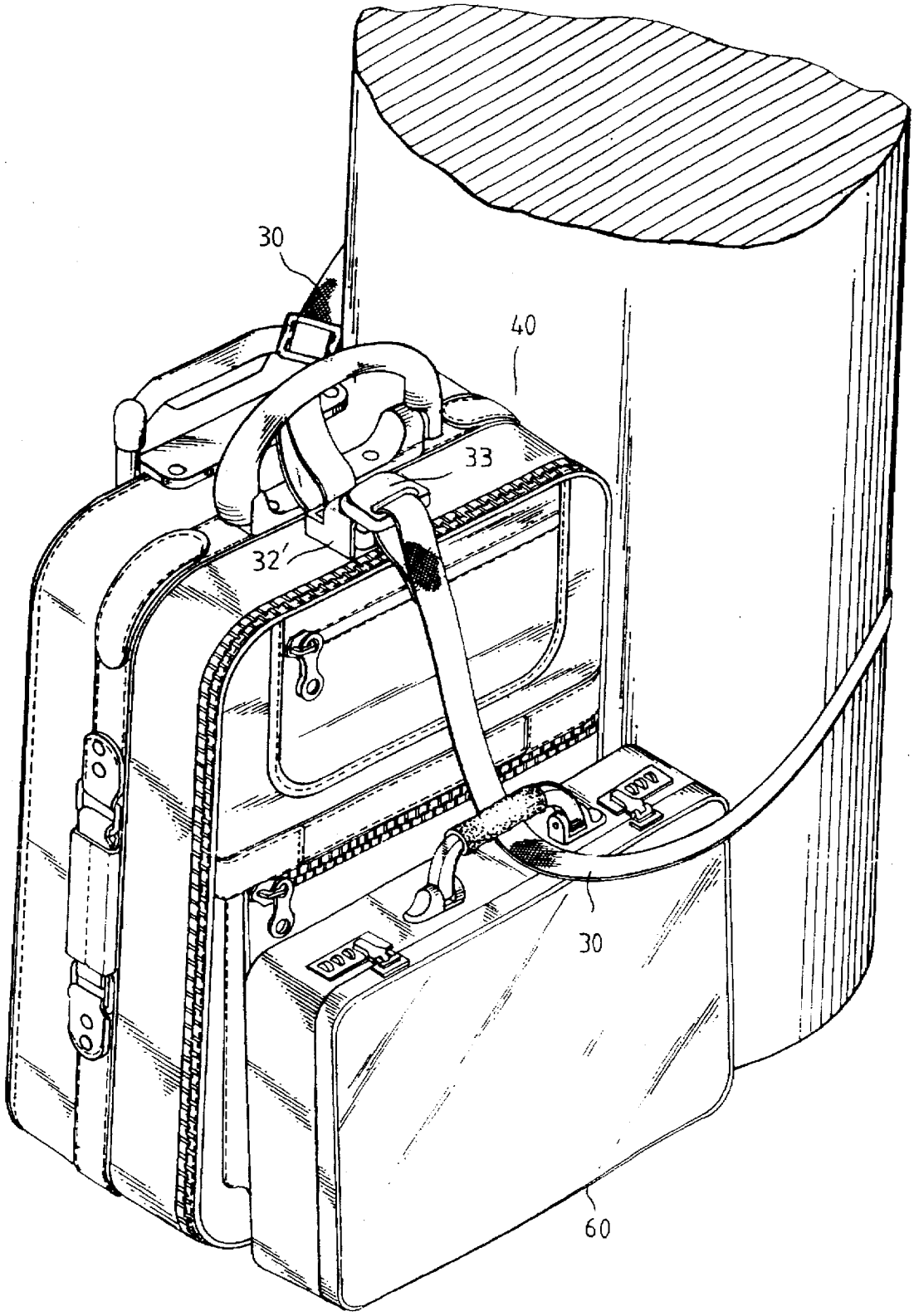
FIG. 11 is a perspective view to show a second operational mode which illustrates a binding strap of the present invention applied to bind a number of luggage cases on a column in an airport or a railway station.
Figure 12:
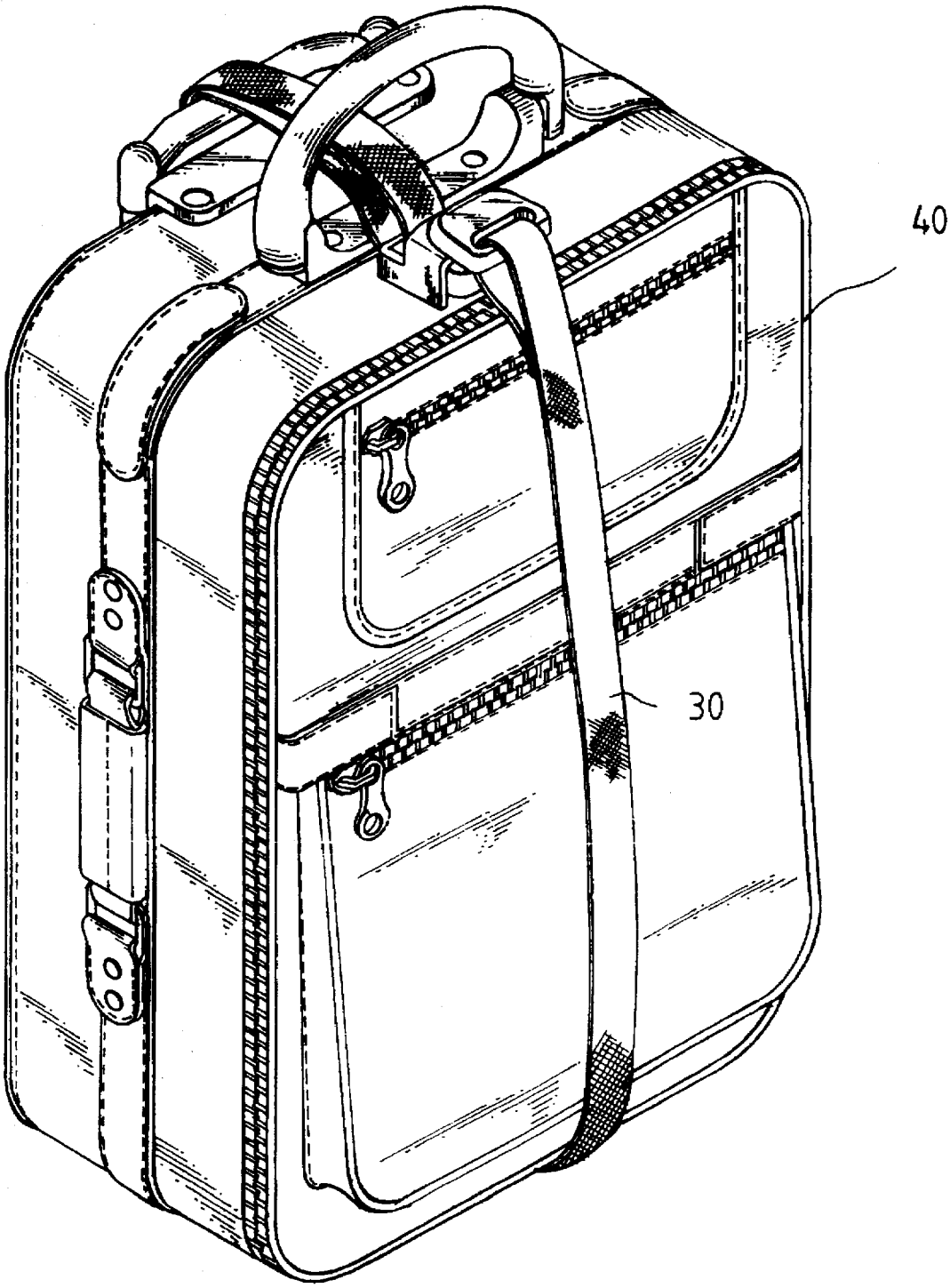
FIG. 12 is a perspective view to show a third operational mode which illustrates a binding strap of the present invention applied to pack the luggage case of it's own.

Referring to FIGS. 10, 11 and 12 of the drawings, there are several operational mode regarding the application of the binding strap 30 with zipper lock 10 of the present invention. FIG. 10 shows a first operational mode, where another suitecase 60 that is bound by the binding strap 30 and locked up by the zipper lock 10 in association with the parent luggage case 40, actually, more luggage cases can be bound together to provide great convenience to a user in travelling. FIG. 11 shows a second operational mode. Before check in at an airport or in a railway station, if the user has to go to shopping or to a lavatory, he may bind all his luggage cases together with the binding strap 30 which is locked up into the zipper lock of a parent luggage case 40 after binding around a nearby column or a door handle. Finally, FIG. 12 shows a third operational mode in which the binding strap 30 is adapted to pack the parent luggage case 40 itself before the check in of the luggage case 40. This can prevent the zipper as well as the frame therein from breaking up during the transportation.

Note that the specification relating to the above embodiments should be construed as examplary rather than as limitative of the present invention, with many variations and modifications being readily attainable by a person of average skill in the art without departing from the spirit or scope thereof as defined in the appended claims and their legal equivalents.

I claim:

1. A zipper lock attached to a luggage case capable of locking sliders of a double zipper and a binding strap comprising:

a zipper lock having a housing and means for closing said housing;

said housing comprising a cam rectangular opening at a center of an arcuate slopped portion, a pair of windows symmetrically arranged at two corners adjacent said rectangular opening, a pair of concaves partitioned by a projection at a center of a flat portion opposite to said arcuate slopped portion thereof and a pair of first latching slots symmetrically formed through an upper wall thereof adjacent said concaves;

a pair of first cylinder posts, a pair of second cylinder posts and a pair of pivots spacedly projected downward at their predetermined positions from the inner surface of said upper wall;

means for attaching said zipper lock onto said luggage case projected downward from predetermined positions inside said housing;

an enclosed U-shaped bulk head surrounding said projection and said concaves having a pair of lateral portions of said U-shaped bulk head connected to an inner wall of said flat portion thereof each having a second latching slot therethrough in communication with said concaves, a transverse portion connected to one end of said projection having a first spring seat on a center thereof, said projection having a concave on an inner side, a transverse abutment connecting the lateral portions of said U-shaped bulk head and the other end of said projection having means for fastening said means for closing said housing projected downward from an under side thereof;

a pair of second spring seats respectively formed abutting an inner surface of side walls thereof;

projecting means for fastening said means for closing said housing at four corners inside said housing;

two sets of positioning means spacedly projected downward from inner surface of said upper wall thereof positioned symmetrically relative to said U-shaped bulk head and adjacent said second spring seats;

a pair of triangular side walls abutting said opening and bridged by a second transverse abutment on the bottom of which has a pair of protrudent means centrally projected downward and a recess on an inward side between said protrudent means;

a push button slidingly disposed into said opening, said push button having a stem projected downward from a bottom thereof and engageable into said recess of said second transverse abutment, a pair of retaining means projected outward from fore corners and stopped against an inward edge of said triangular side walls, a wedged portion projected inward from the middle of fore end between said retaining means and a rectangular recess centrally formed at the fore end thereof beneath said wedge portion;

an actuating means slidingly disposed into said housing beneath said push button, said means having a rectangular flat portion received into said rectangular recess of said push button, a hollow wedged portion capable of enclosing said wedged portion of said push button, an aperture centrally formed through a bottom, a third spring seat centrally formed at a fore end made in registry with said first spring seat and biased by a first spring means therebetween and a support stem projected upward from a top thereof;

a pair of first latching pivoted means each having a sleeve pivoted onto said first posts in symmetrical manner, a latch towards said second latching slots extended outward from a periphery of said sleeve and a lever extended outward from an opposite periphery of said sleeve and intersecting each other with their intersection stopped against the support stem of said actuating means and the wedged portion therebetween;

a pair of coupling means each having a sleeve pivoted onto said second posts in symmetrical manner, a first extension extended from a periphery of said sleeve having a perpendicular portion stopped into the aperture of said actuating means therein and a second extension extended from an opposite periphery of said sleeve having a hook at free end thereof engageable with a recess of a combination lock which has a pair of dials pivoted onto said pair of pivots inside said housing and biased by a pair of second spring means and accessible from outside of said pair of windows;

a pair of second latching means slidingly disposed into said housing between said first latching means and said second spring seats and limited by said positioning means, said second latching means each having a hollow rectangular body, a beveled latch which is made in registry with said first latching slots at an upper portion thereof and a fourth spring seat at an outward end for biasing a third spring means with said second spring seat therebetween;

a spring plate for ejecting the pull tabs of said double zipper secured to said means for fastening said housing and said means for closing said housing therebetween, said spring plate having a U-shaped body, a pair of screw holes through a transverse portion of said U-shaped body made in registry with said fastening means and a pair of lateral portions inserted through said concaves;

said means for closing said housing having a first flat body conforming with the bottom of said housing and a plurality of screw holes adjacent four corners made in registry with said projecting means for mounting said means for closing said housing onto said housing by means of fasteners;

a binding strap capable of locking into said first latching slots of said zipper lock, said strap comprising a strap, a coupling means crossing bound into said strap, a locking means bound to one end of said strap and a buckle bound to the other end of said strap and through the body thereof;

said coupling means having a second flat body conforming with the shape of said zipper lock, a pair of third latching slots through the body made in registry with said first latching slots of said housing and an aperture adjacent a flat portion for securing said strap therein;

said locking means having a third flat body conforming with the shape of said coupling means, a pair of locking tabs each having an eyelet therein spacedly projected outward from a flat surface thereof, an ejecting means projected downward between said locking tabs and an aperture adjacent a flat portion for fastening said strap therein.

2. A zipper lock according to claim 1 wherein said coupling means of said binding strap has a raised body conforming with the shape of said housing.

3. A zipper lock according to claim 1 wherein said zipper lock and said locking means of said binding strap are adaptable to a briefcase.

4. A zipper lock according to claim 1 wherein said binding strap is applied to bind additional luggage cases together with a portable parent luggage case.

5. A zipper lock according to claim 1 wherein said binding strap is adaptable to bind a series of luggage cases onto a column or a door handle.

6. A zipper lock according to claim 1 wherein said binding strap is adaptable to pack a portable parent luggage case.

* * * * *